US006019146A

United States Patent [19]

Taylor

[11] Patent Number: 6,019,146

[45] Date of Patent: Feb. 1, 2000

[54] FUEL NOZZLE DISPENSER USING ULTRASONIC METERING

[75] Inventor: Ken W. Taylor, Austin, Tex.

[73] Assignee: Dresser Industries, Inc., Dallas, Tex.

[21] Appl. No.: 09/087,314

[22] Filed: May 29, 1998

[51] Int. Cl.[7] ..... B65B 31/00

[52] U.S. Cl. ..... 141/59; 141/4; 141/5; 141/100; 141/104; 141/105; 141/206; 141/210; 222/26; 222/28; 222/145.1; 73/703

[58] Field of Search ..... 141/2, 4, 5, 9, 141/100–107, 59, 67, 206, 210, 382, 392, 94–96; 222/14, 26, 28, 71, 145.1, 145.3; 73/703

[56] References Cited

U.S. PATENT DOCUMENTS 3,590,890 7/1971 Young ..... 141/192
4,320,659 3/1982 Lynnworth et al. .
4,827,960 5/1989 Nitzberg et al. ..... 137/68.15
4,978,029 12/1990 Furrow et al. ..... 222/1
5,018,645 5/1991 Zinsmeyer ..... 222/14
5,184,309 2/1993 Simpson et al. .
5,594,181 1/1997 Stange ..... 73/861.28

*Primary Examiner*—Henry J. Recla
*Assistant Examiner*—Timothy L. Maust
*Attorney, Agent, or Firm*—Haynes & Boone, L.L.P.

[57] ABSTRACT

A multi-product fuel dispensing system is provided for dispensing a plurality of fuels stored in a plurality of reservoir tanks. A fuel delivery conduit delivers a specific grade of fuel from one or more of the reservoir tanks. The conduit includes at least two flow channels, one for conveying a first grade of fuel and another for conveying a second grade of fuel. A nozzle connected to the conduit includes a blend valve for each flow channel. The nozzle can deliver the first grade of fuel, the second grade of fuel or a third grade of fuel comprising a blend of the first and second grades of fuel. An ultrasonic flow meter is mounted in the nozzle to measure the flow of fuel.

20 Claims, 4 Drawing Sheets

Fig. 3
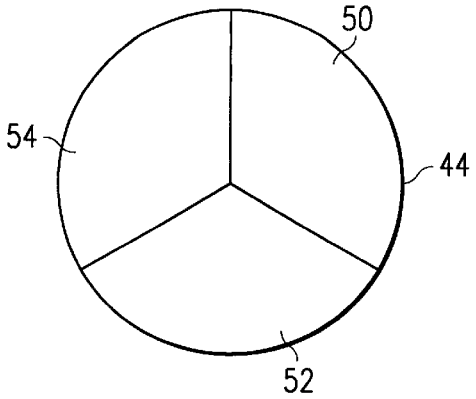
Fig. 3A
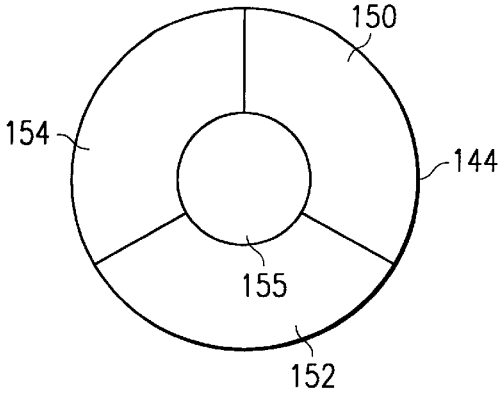
Fig. 4
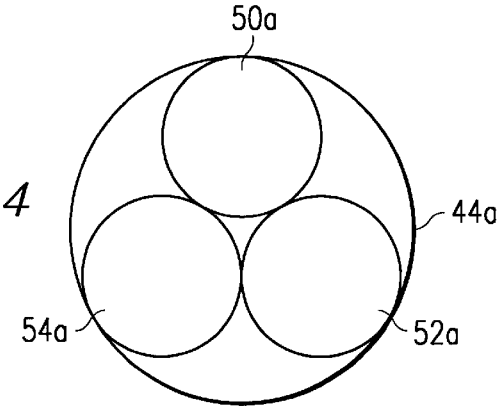
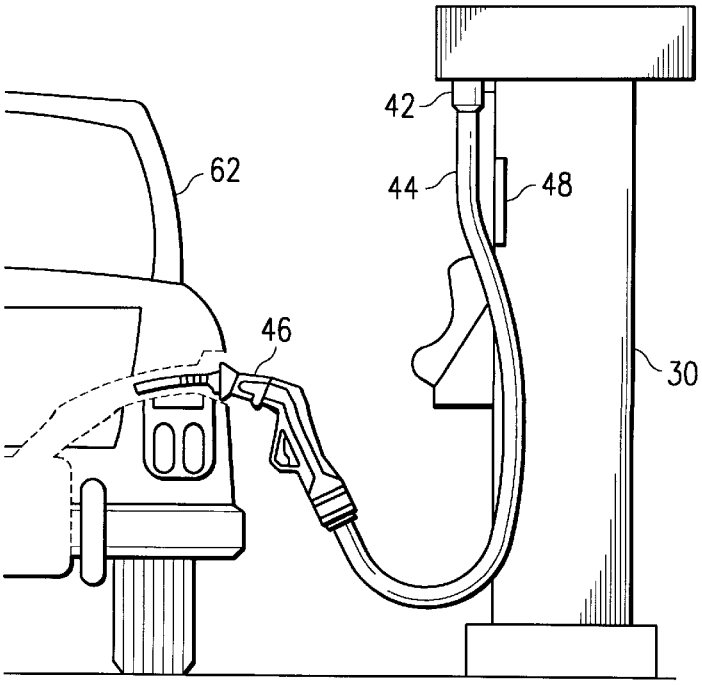
Fig. 5

FUEL NOZZLE DISPENSER USING ULTRASONIC METERING

BACKGROUND

This invention relates to a multi-product fuel dispenser and, more particularly, to such a dispenser that feeds more than one product through an ultrasonic metering device and a single hose and nozzle.

Many gasoline service stations require the installation of multi-product fuel dispensers or pumps, each for dispensing a plurality of different grades, or octane levels, of gasoline products at each fueling station. Conventionally, three different products are provided per fueling station, namely a high octane fuel, a medium octane fuel and a low octane fuel. In the past, multi-product dispensers had a separate hose for each product. Now, many such dispensers use the same hose and nozzle to dispense all products. Mixing of these various products can result in the dilution or lowering of the octane level of the high and medium octane fuels which can lower the octane level of the fuel delivered to the customer. Testing procedures have therefore been developed in the United States to certify the octane levels of the fuels dispensed from commercial fuel dispensers. The testing and certification procedures are set forth in the National Conference on Weights and Measures Publication No. 12, entitled "Examination Procedure Outlines for Weighing and Measuring Devices." Pursuant to these testing guidelines, the person conducting the test is required to flush at least 0.3 gallons of fuel from the dispenser before taking the test sample. See page 57, line 1. Thus, in dispensers used at United States gasoline service stations, a slight mixing of the various fuel products of a multi-product fuel dispenser may occur, so long as the contaminated product is flushed from the system during the first 0.3 gallons of discharge.

To avoid the mixing of the various products dispensed from a multi-product fuel dispenser, known dispensers typically include a separate flow path for each product from its reservoir product tank which stores the fuel, to the outlet nozzle which introduces the fuel into the consumer's automobile. These systems therefore require the duplication of the components disposed between the tank and the nozzle for each fuel product, including the flow meter. In this manner, however, no contamination of the octane level of the products can occur. Through the use of such separate hoses, meters, etc., dispensers of the prior art avoid contamination of fuel being dispensed at a particular time, with fuel from a previous use that would otherwise remain in the system at the termination of the last dispensing cycle. Spalding, U.S. Pat. No. 5,332,011, a patent assigned to the assignee of the present invention, discloses such a dispenser, in which three nozzles, fuel hoses and flow meters, each for a different grade of gasoline, are combined in a single dispenser.

There are many disadvantages in the use of discrete delivery systems for each product fed through a multi-product fuel dispenser. For example, the cost of such dispensers is increased due to the requirement for multiple hoses, nozzles and meters. Also, the overall size and space requirements of such a dispenser are increased due to the requirement to house the multiple components. In addition, and especially with respect to the flow meters, the cost of maintenance and repairs is increased for each discrete delivery system included in such dispensers.

Other multi-product fuel dispensers have been developed in which the supply lines from each reservoir tank are manifolded into a single fuel hose downstream of the flow meter, which hose then leads to a single nozzle. Although this eliminates the cost of the multiplicity of nozzles and hoses, the problems associated with the multiplicity of flow meters, such as complexity, space limitations and repair and maintenance expenses, remain.

In one known device, different grades of fuel from three different storage sources can be delivered through a common meter and then dispensed through a dedicated hose and nozzle for each fuel grade. A specific valving arrangement controls the flow of a specific fuel grade through the meter and to the dedicated hose and nozzle. As an alternative, different grades of fuel from three different storage sources can be delivered through a common meter and then selectively dispensed through a single hose and nozzle. In this arrangement, valving selectively directs a specific fuel grade to the common meter and the meter is connected to the single hose and nozzle.

In another arrangement, fuel delivery of various grades, through a single hose and nozzle, is accomplished from two different grades of fuel (i.e., highest octane and lowest octane) stored separately. Here again, a specific valving arrangement controls the delivery of the selected fuel grade. The separately stored fuels may be blended to deliver one or more intermediate grades of fuel. This may be accomplished by proportional blending or fixed ratio blending. In proportional blending, various intermediate grades are a selectively blended mixture of some proportion of the high and low octane fuels. In fixed ratio blending, a single intermediate grade is produced including a fixed percentage of the high and low octane fuels.

In all blending dispensers there are two separate sets of hydraulics. One set is for controlling the low octane product input and another set is for controlling the high octane product input. In blending dispensers, whether of the proportional or fixed ratio type, the low and high octane hydraulic systems each contain a proportional flow control valve.

When any grade (low, high or blend) is selected, the blend ratio programmed into the dispenser's computer determines the percentage or proportion of high product to be dispensed. When the low grade product is selected, the proportion or percentage of high product is 0%. When the high grade product is selected, the percentage of high product is 100%. When a blended grade is selected, a percentage of high product (less than 100%) is mixed with the remaining percentage of low product, and the combined total (100%) determines the octane rating of the blended grade.

Knowing the percentage or proportion of high, and thus low, product to dispense and by calculating the volume dispensed based on input signals from the pursers, the computer signals the solenoid drive board which in turn controls the proportional flow control valves. Each proportional flow control valve continuously opens or closes, as directed by the solenoid drive board, to maintain the desired blend ratio and the maximum allowable flow rate.

A complication arises with regard to the allowable 0.3 gallon contamination factor. Some gasoline station operators would prefer to have a dispenser hose provided with a greater than normal length. The normal hose length provided is about 12 feet. The volume of fuel retained in a 12 foot length of hose and the volume of fuel in the flow meter approximates the allowable 0.3 gallon contamination factor. Therefore, extending the hose length to, for example, 13 feet may cause the system to exceed the 0.3 gallons of allowable contamination due to the increased volume of the extended length of the hose.

In Europe, the 0.3 gallon contamination factor is generally not permitted. In fact, only the minimal nozzle volume contamination is permitted. Therefore, separate nozzles and hoses are required for each grade of fuel product. In one attempt to overcome some of the above problems, however, multi-product fuel dispensers have been developed that comprise tri-axial fuel hoses having three concentric passages within a single hose that lead to a single nozzle. Such devices simplify operation for the consumer as there is only a single nozzle, but they do not alleviate the need for separate flow meters for each product or improve the maintenance and repair costs. Moreover, such devices might actually increase the cost of the dispenser due to the complexity of the tri-axial hoses.

The present meters include a mechanical positive displacement meter using technology which is over 50 years old. This meter includes over 100 parts, is cumbersome, not service friendly, and not easily interfaced with modern microprocessor based control systems. Although some electronic flow sensing devices have been recently introduced, present meters are of too large a volume, e.g., in excess of about 0.1 gallons, which is one-third of the permissible 0.3 gallons. Volume of these meters is large to produce the desired system flow rate of 10 gallons per minute (gpm). This means that the other components of the system which contribute to product contamination must be limited to no more than 0.2 gallons.

More recently, a multiple compartment hose has been developed. One compartment carries a low octane product, another compartment carries a high octane product and a third compartment is for vapor recovery. This, permits single hose dispensing using a nozzle with a blend valve. One such nozzle has been developed including an in line flow meter, valve and check valve arrangement. However, the proposed flow meter is described as a turbine flow meter. Adding these features to the nozzle will add size and weight to the nozzle. In addition, a multiple compartment hose may include separate compartments for delivering three grades of fuel and a fourth compartment for vapor recovery in a non-blending system.

Therefore, what is needed is an economically feasible meter of smaller volume, i.e., substantially less than 0.1 gallons, able to operate within a nozzle in combination with a three compartment hose and a blend valve in the nozzle at the system flow rate of 10 gpm, reliable due to few or no moving parts, and capable of almost infinite life.

SUMMARY

One embodiment, accordingly, provides a multi-product fuel dispensing system which has improved flow metering capabilities and avoids unwanted product contamination problems associated with presently used metering devices. To this end, a multi-product fuel dispensing system is provided for dispensing a plurality of grades of fuel stored in a plurality of reservoir tanks. A fuel delivery line is connected to each reservoir tank. A fuel delivery conduit is connected to receive fuel from each fuel delivery line. The conduit includes at least two flow channels, one for conveying a first grade of fuel and another for conveying a second grade of fuel. A nozzle connected to the conduit includes a blend valve for each flow channel. The nozzle can deliver the first grade of fuel, the second grade of fuel or a third grade of fuel comprising a blend of the first and second grades of fuel. An ultrasonic flow meter is mounted in the nozzle to measure the flow of the fuel.

A principle advantage of this embodiment is that there is little or no contamination which can only occur between the end of the hose and the blend valve in the nozzle. Hose length is no longer an issue related to the contamination factor. Products are kept separate using a partitioned hose. The final product may be blended and/or measured in the nozzle. Therefore, in the U.S. where some contamination is allowed, the system permits added hose length without contamination consequences. In Europe, or anywhere there is no contamination tolerance, this system presents a means for providing a single dispenser, single meter system.

BRIEF DESCRIPTION OF THE DRAWINGS

FIG. 3 is a cross-sectional view illustrating an embodiment of a multi-compartment hose.

FIG. 3A is a cross-sectional view illustrating an embodiment of an alternative multi-compartment hose.

FIG. 4 is a cross-sectional view illustrating another embodiment of a multi-compartment hose.

FIG. 5 is a diagrammatic view illustrating an embodiment of a fuel dispenser, dispensing fuel to a vehicle.

DETAILED DESCRIPTION OF THE PREFERRED EMBODIMENT

Figure 1:
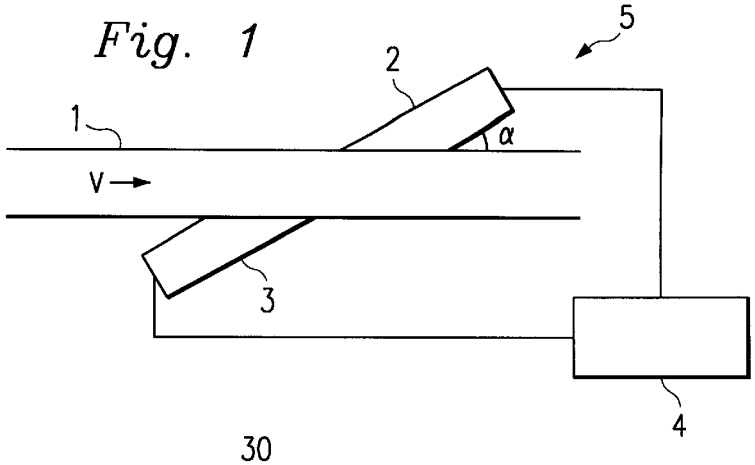
FIG. 1 is a schematic view illustrating an embodiment of an ultrasonic meter using the sing-around measurement technique.

FIG. 1 generally illustrates the principle of sing-around type measurement. A fluid having the velocity v flows in a tube 1 from the left to the right through an ultrasonic flow meter 5. On each side of the tube 1, there is provided an ultrasonic transducer 2 and 3, respectively, which forms an angle with the longitudinal axis of the tube 1. The transducers 2, 3 are interconnected by means of a sing-around electronics, which are represented in the form of a box 4.

The velocity v of the fluid is measured in the tube 1. A sing-around loop is first established in the one direction by the sing-around electronics 4 exciting the transducer 2 to transmit an ultrasonic pulse, which is received by the transducer 3 after passing through the fluid in the tube 1. When detecting that the transducer 3 is receiving an ultrasonic pulse, the sing-around electronics 4 excite the transducer 2 to transmit a new ultrasonic pulse. The thus-established sing-around loop is maintained for a predetermined number of turns. Then, this procedure is repeated in the downstream direction.

The sing-around loop will oscillate with a certain period, which is referred to as the sing-around period and which depends on the sound velocity in the fluid between the transducers 2 and 3, the distance between the transducers 2 and 3, and the fluid velocity v. The sing-around period in the downstream direction is measured and the sing-around period in the upstream direction is measured. If the distance between the transducers 2 and 3 and the angle between the respective transducers 2 and 3 and the tube are known, and if the sing-around periods are measured, the fluid velocity v can thus be calculated and may be used for determining e.g. the flow rate of mass in the tube 1. With the aid of the sing-around periods, the sound velocity in the fluid may be calculated.

In actual practice, the sing-around periods are determined by measuring the time it takes for the ultrasonic pulses to do the predetermined number of turns in the sing-around loops, and dividing it by that predetermined number. When calculating the fluid velocity and the sound velocity, a time correction for the delays in the electronics is made.

Figure 2:
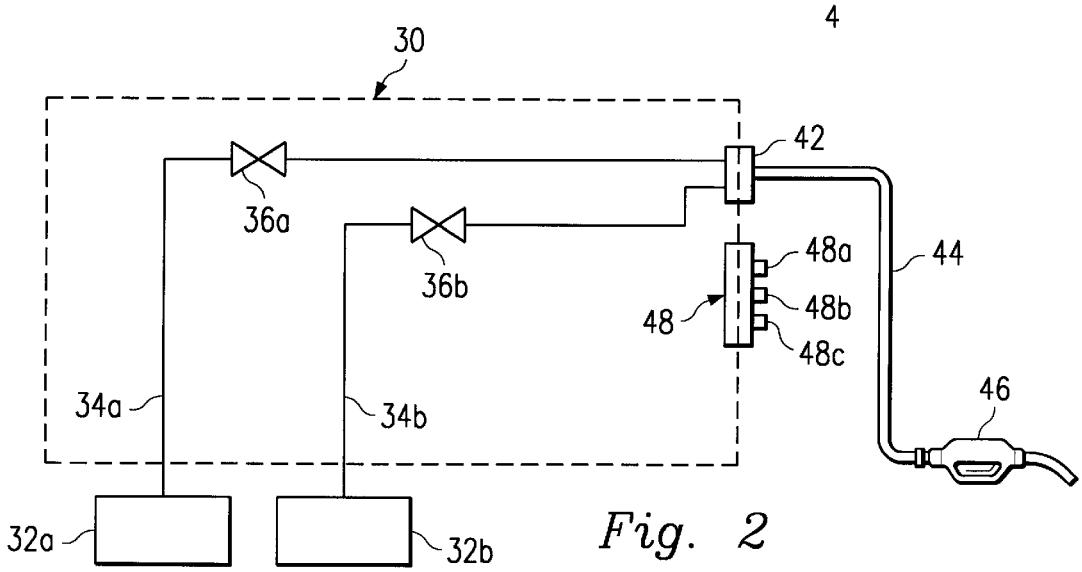
FIG. 2 is a schematic view illustrating an embodiment of a fuel dispensing system.

Referring now to FIG. 2, a multi-product fuel dispenser of the present invention is shown schematically and generally referred to with reference numeral 30. The dispenser 30 receives fuel from a plurality of underground fuel reservoir tanks 32*a*, 32*b*, each of which stores a different grade of fuel such as high and low octane respectively. Also, separate fuel delivery lines 34*a*, 34*b* pass the fuel from the reservoir tanks 32*a*, 32*b* into the dispenser 30 under the control of flow control valves 36*a*, 36*b*. However, in the dispenser 30 of the present invention, the fuel delivery lines 34*a*, 34*b*, attach via an outlet casting 42 to a multi-compartment hose 44 and remain separated in the hose until being blended at a nozzle 46.

Figure 2A:
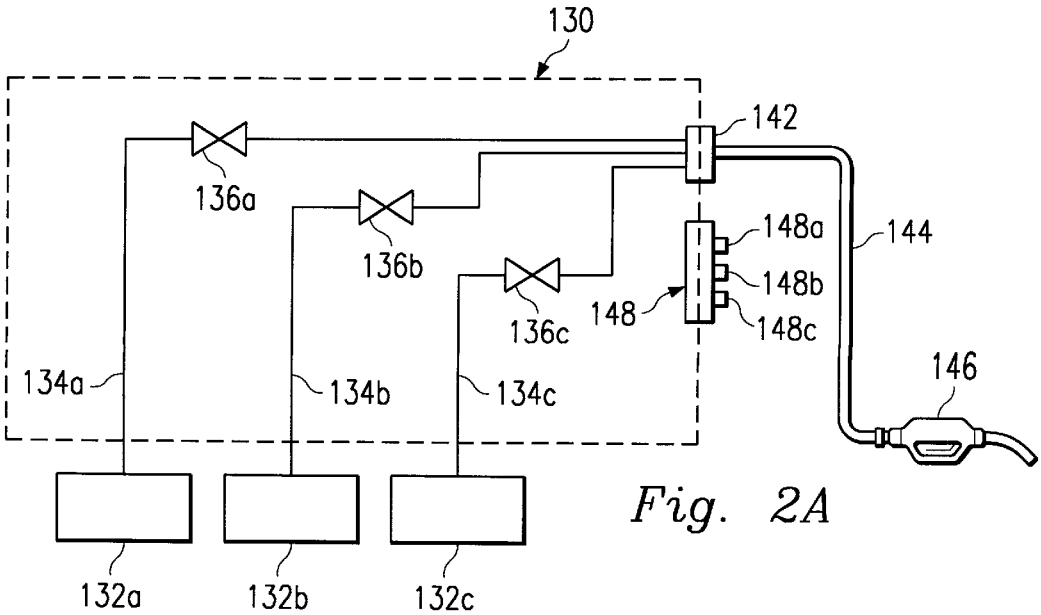
FIG. 2A is a schematic view illustrating an alternative embodiment of a fuel dispensing system.

Referring now to FIG. 2A, an alternative non-blending multiproduct fuel dispenser of the present invention is shown schematically and generally referred to with reference numeral 130. The dispenser 130 receives fuel from a plurality of underground fuel reservoir tanks 132*a*, 132*b*, and 132*c* each of which stores a different grade of fuel such as high, medium and low octane respectively. Also, separate fuel delivery lines 134*a*, 134*b*, and 134*c* pass the fuel from the reservoir tanks 132*a*, 132*b*, 132*c* respectively, into the dispenser 130 under the control of flow control valves 136*a*, 136*b* and 136*c*. However, in the dispenser 130 of the present invention, the fuel delivery lines 134*a*, 134*b*, 134*c* attach via an outlet casting 142 to a multi-compartment hose 144 and remain separated in the hose until being individually dispensed at a nozzle 146.

The operation of dispenser 30 FIG. 2, includes the customer pre-selecting a desired grade of fuel from a product selection panel 48 by pressing an appropriate one of the selection buttons, 48*a*, 48*b* or 48*c*. Selection is electronically communicated to blend valve (discussed below) which functions to deliver the selected fuel which may be either the high octane fuel, the low octane fuel or a blend of the high and low octane fuels thus producing a fuel product having an octane rating between the high and low octane fuel products, respectively.

In FIGS. 3 and 4, the multi-compartment hoses 44 and 44*a* are illustrated, respectively. Hose 44, FIG. 3, is partitioned and includes a first conduit 50 for conducting a first octane product from fuel delivery line 34*a* to nozzle 46. Also included in hose 44 is a second conduit 52 for conducting a second octane product, different from the first octane product, from fuel delivery line 34*b* to nozzle 46. A third conduit 54 in hose 44 provides for vapor recovery. Alternatively, in FIG. 4, a multi-compartment hose 44*a* includes a first conduit 50*a*, a second conduit 52*a* and a third conduit 54*a* corresponding to conduits 50, 52 and 54, respectively. The arrangement described thus far permits the high and low octane fuels to be pre-selected at product selection panel 48 and remain separated while being conducted through multi-compartment hose such as hose 44. Thus, both the high and low octane fuels remain separated as they pass through hose 44 for delivery to nozzle 46.

An alternative hose 144, FIG. 3A, is provided for connection to the non-blending multiproduct fuel dispenser 130 of FIG. 2A. Hose 144, FIG. 3A, is partitioned and includes a first conduit 150 for conducting a first octane product from fuel delivery line 134*a* to nozzle 146. Also included in hose 144 is a second conduit 152 for conducting a second octaine product from fuel delivery line 134*b* to nozzle 146. A third conduit 154 in hose 144 conducts a third octaine product, from fuel delivery line 134*c* to nozzle 146. A fourth conduit 155 in hose 144 provides for vapor recovery.

Figure 6:
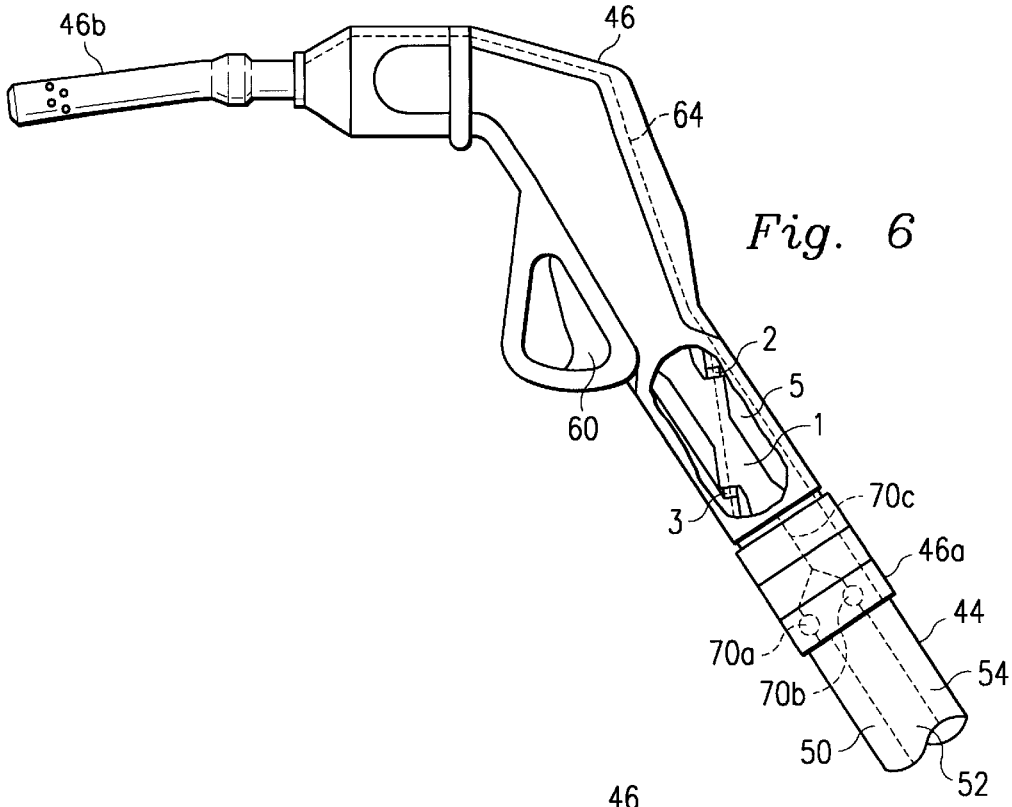
FIG. 6 is a side view, partially cut-away, illustrating an embodiment of a fuel dispensing nozzle.

In FIG. 5, outlet casting 42 is attached to dispenser unit 30. Hose 44 extends from outlet casting 42 to nozzle 46. Product selection is made at product selection panel 48, and fuel is delivered to vehicle 62 via nozzle 46. The nozzle 46, FIG. 6, includes an inlet end 46*a* and a delivery end 46*b*. The nozzle 46 is hand-held in the usual manner and manual operation of an actuating trigger 60 after fuel grade selection is made, controls fuel delivery from nozzle 46 to the vehicle 62, FIG. 5, or the like. Again in FIG. 6, nozzle 46 includes a vapor recovery conduit 64 therein which extends from adjacent the nozzle delivery end 46*b* to the nozzle inlet end 46*a*. In this manner, vapor recovery conduit 64 interconnects with vapor recovery conduit 54 of hose 44, FIG. 3.

First conduit 50 delivers the first octane product to a first blend valve 70*a* in nozzle 46. Second conduit 52 delivers the second octane product to a second blend valve 70*b* in nozzle 46. The blend valves 70*a* and 70*b* function in the usual manner, depending on product selection, and deliver either the first product, the second product or a third product comprising a blend of the first and second products. In any case, the selected product exits to a conduit 70*c* and enters tube 1 of ultrasonic flow meter 5 and measurement is accomplished by the transducers 2 and 3 as described above. The electronics in box 4, FIG. 1, communicate from the nozzle 46 to dispenser 30, FIGS. 2 and 5 in a known manner and may be hard wired via hose 44.

Figure 7:
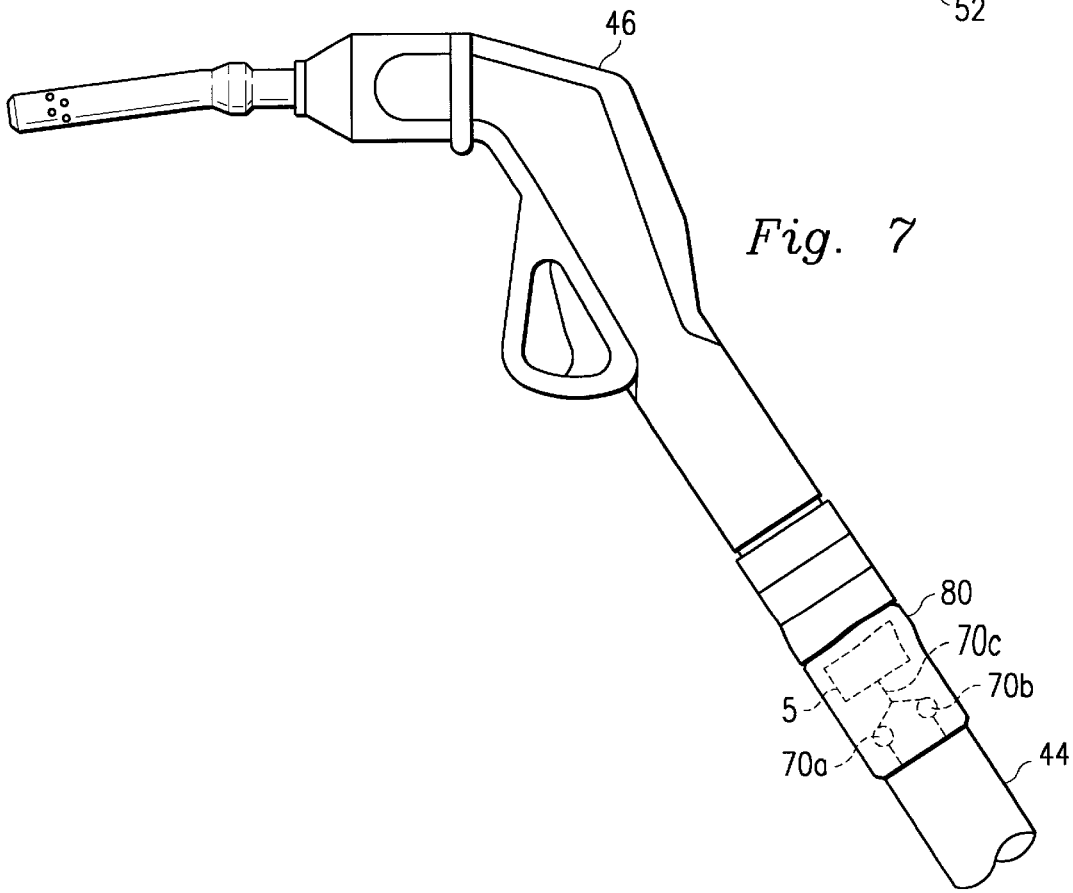
FIG. 7 is a side view illustrating another embodiment of a fuel dispensing nozzle.

In another embodiment, a modified attachment 80, FIG. 7, to hose 44 may house blend valves 70*a*, 70*b*, conduit 70*c*, and ultrasonic meter 5. The attachment 80 may be a well-known breakaway attachment of the type used to limit damage to a fuel dispenser when a customer forgets to remove nozzle 46 from vehicle 62, FIG. 5, and drives off with the nozzle 46 still engaged with the vehicle. In this manner, the nozzle 46, may break free of hose 44 and attachment 80 thus permitting the blend valves 70*a*, 70*b*, FIG. 7, and ultrasonic meter 5 to remain with hose 44 in attachment 80.

Figure 8:
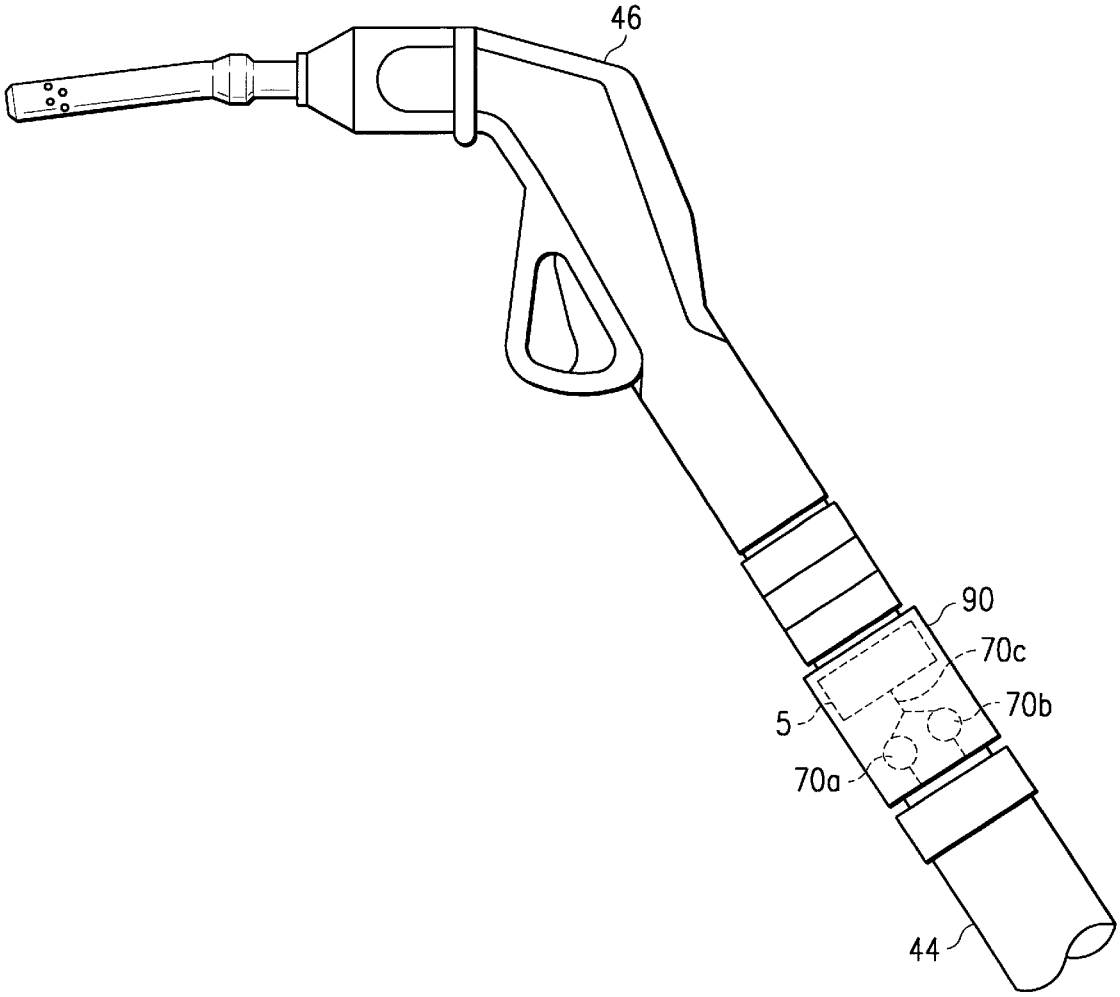
FIG. 8 is a side view illustrating a further embodiment of a fuel dispensing nozzle.

In still another embodiment, a modified swivel connection 90, FIG. 8, connected between hose 44 and nozzle 46, may house blend valves 70*a*, 70*b*, conduit 70*c*, and ultrasonic meter 5. The swivel connection 90 provides a swivel device interconnecting hose 44 and nozzle 46 so as to provide improved freedom of movement of nozzle 46 relative to hose 44, in the event that hose 44 becomes twisted from repeated use. Swivel connection 90 may be used with or without a breakaway attachment 80 as described above. It should be noted that in connection with the above-described blend systems used with the dispenser of FIG. 2, blend valves 70*a* and 70*b* may not be required because flow control valves 36*a* and 36*b* may also be provided to function as blend valves.

As it can be seen, the principal advantages of these embodiments include little or no contamination which can occur between the end of the hose and the blend valve in the nozzle. Hose length is no longer an issue related to the contamination factor. Products are kept separate using a partitioned hose. The delivered product may be blended and/or measured in the nozzle or immediately adjacent the nozzle.

As such, one embodiment provides a multi-product fuel dispensing system which includes a plurality of reservoir tanks, each tank having a specific grade of fuel stored therein, and each grade being different from each other grade. Each reservoir tank is connected to a respective fuel delivery line. A fuel delivery conduit which has at least two flow channels, is connected to receive fuel from each fuel delivery line. A nozzle is connected to receive fuel from the fuel delivery conduit, and a blend valve for each flow channel is mounted in the nozzle for selectively delivering each specific grade of fuel from the tanks or for delivering a blend of the specific grades of fuel. An ultrasonic flow meter is mounted adjacent the blend valve for measuring the flow of the fuel through the nozzle.

Another embodiment provides a multi-product fuel dispensing system including first and second reservoir tanks each storing, respectively, a first and a second grade of fuel. A first fuel delivery line is connected to the first tank, and a second fuel delivery line is connected to the second tank. Each fuel delivery line includes a respective flow control valve. A fuel delivery conduit includes at least two flow channels connected to receive fuel from the fuel delivery lines such that one of the flow channels receives fuel from the first fuel delivery line and the other of the flow channels receives fuel from the second fuel delivery line. A nozzle is connected to receive fuel from the fuel delivery conduit. A blend valve for each flow channel is mounted in the nozzle for selectively delivering the first grade of fuel, the second grade of fuel, or a blend including the first and second grades of fuel. An ultrasonic flow meter is mounted adjacent the blend valve for measuring the flow of fuel delivered through the nozzle.

A further embodiment provides a method of measuring multi-grade fuel flow by connecting a multi-conduit fuel delivery line to separately receive a first and a second grade of fuel from a first and a second fuel source, respectively. A nozzle is attached to the multi-conduit fuel delivery line to separately receive the first and second grades of fuel, which are passed through a respective blend valve prior to delivering a pre-selected grade of fuel from the nozzle. The pre-selected grade of fuel is also passed through an ultrasonic flow meter prior to delivering the pre-selected fuel from the nozzle.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A fuel delivery nozzle comprising:

a housing having an inlet and an outlet;

the inlet including a first conduit and a second conduit for respectively receiving a first grade of fuel and a second grade of fuel;

a first and a second blend valve respectively connected to the first and the second conduits;

an ultrasonic flow meter mounted in the housing adjacent the blend valves for measuring the flow of fuel delivered through the nozzle; and a single conduit interconnecting the blend valves and the ultrasonic flow meter.

2. The nozzle as defined in claim 1 wherein the inlet is attached to a multi-compartment fuel delivery conduit.

3. The nozzle as defined in claim 2 wherein the housing includes a vapor recovery conduit.

4. The nozzle as defined in claim 3 wherein the vapor recovery conduit in the housing is connected to the fuel delivery conduit.

5. A multi-product fuel dispensing system comprising:

a plurality of reservoir tanks, each tank having a specific grade of fuel stored therein, each grade being different from each other grade;

each reservoir tank having a fuel delivery line connected thereto;

a fuel delivery conduit having a nozzle end and at least two flow channels, a first flow channel connected to receive one grade of fuel from one fuel delivery line, and a second flow channel connected to receive another grade of fuel from another fuel delivery line;

a nozzle having an inlet and an outlet, the inlet connected to receive fuel from the nozzle end of the fuel delivery conduit;

a first and a second blend valve respectively connected to the first and second flow channels adjacent the nozzle inlet for selectively delivering each specific grade of fuel from the tanks, and for selectively delivering a blend of specific grades of fuel to the outlet of the nozzle; and an ultrasonic flow meter mounted between the blend valves and the nozzle outlet for measuring the flow of fuel through the nozzle.

6. The system as defined in claim 5 wherein the fuel delivery conduit includes a third flow channel for vapor recovery.

7. The system as defined in claim 5 wherein the ultrasonic flow meter is mounted in the nozzle.

8. The system as defined in claim 5 wherein the ultrasonic flow meter is attached to the nozzle.

9. The system as defined in claim 5 wherein the ultrasonic flow meter is mounted between the fuel delivery conduit and the nozzle.

10. The system as defined in claim 5 further comprising a swivel attachment interconnecting the fuel delivery conduit and the nozzle, the ultrasonic flow meter being mounted in the swivel attachment.

11. A multi-product fuel dispensing system comprising:

a first reservoir tank storing a first grade of fuel;

a second reservoir tank storing a second grade of fuel;

a first fuel delivery line connected to the first tank, the first line including a first flow control valve;

a second fuel delivery line connected to the second tank, the second line including a second flow control valve;

a fuel delivery conduit having a nozzle end and at least two flow channels, a first flow channel connected to receive fuel from the first fuel delivery line, and a second flow channel connected to receive fuel from the second fuel delivery line;

a nozzle having an inlet and an outlet, the inlet connected to receive fuel from the nozzle end of the fuel delivery conduit;

a first and a second blend valve respectively connected to the first and second flow channels adjacent the nozzle inlet for selectively delivering the first grade of fuel, the second grade of fuel, and a blend including the first and second grades of fuel to the outlet of the nozzle;

an ultrasonic flow meter mounted between the blend valves and the nozzle outlet for measuring the flow of fuel through the nozzle; and a conduit interconnecting the blend valves and the ultrasonic flow meter.

12. The system as defined in claim 11 wherein the fuel delivery conduit includes a third flow channel for vapor recovery.

13. The system as defined in claim 11 wherein the ultrasonic flow meter is mounted in the nozzle.

14. The system as defined in claim 11 wherein the ultrasonic flow meter is attached to the nozzle.

15. The system as defined in claim 11 wherein the ultrasonic flow meter is mounted between the fuel delivery conduit and the nozzle.

16. The system as defined in claim 11 further comprising a swivel attachment interconnecting the fuel delivery conduit and the nozzle, the ultrasonic flow melter being mounted in the swivel attachment.

17. A method of measuring multi-grade fuel flow comprising the steps of:

connecting a multi-conduit fuel delivery line to receive a first and a second grade of fuel from a first and a second fuel source, respectively;

attaching a nozzle having an inlet and an outlet to the multi-conduit fuel delivery line to receive the first and second grades of fuel at the nozzle inlet;

passing the first and second grades of fuel through a first and a second blend valve, respectively, the first and second blend valves being adjacent the nozzle inlet, prior to delivering a pre-selected grade of fuel from the nozzle;

passing the pre-selected fuel from the blend valves to a single conduit and through an ultrasonic flow meter adjacent the nozzle inlet; and passing the fuel from the ultrasonic flow meter to the nozzle outlet.

18. The method as defined in claim 17 wherein the pre-selected grade of fuel is the first grade of fuel.

19. The method as defined in claim 17 wherein the pre-selected grade of fuel is the second grade of fuel.

20. The method as defined in claim 17 wherein the pre-selected grade of fuel is a third grade of fuel including a combination of the first and second grades of fuel.

* * * * *